US012098566B1

(12) United States Patent
DeWitt

(10) Patent No.: US 12,098,566 B1
(45) Date of Patent: Sep. 24, 2024

(54) TRIMMER LINE SHIELD FOR CHAIN LINK FENCES

(71) Applicant: Ronald A. DeWitt, Corpus Christi, TX (US)

(72) Inventor: Ronald A. DeWitt, Corpus Christi, TX (US)

( * ) Notice: Subject to any disclaimer, the term of this patent is extended or adjusted under 35 U.S.C. 154(b) by 679 days.

(21) Appl. No.: 16/507,034

(22) Filed: Jul. 10, 2019

(51) Int. Cl.
*E04H 17/06* (2006.01)
*E04H 17/08* (2006.01)

(52) U.S. Cl.
CPC ..... *E04H 17/063* (2013.01); *E04H 17/08* (2013.01)

(58) Field of Classification Search
CPC .. A01G 9/28; A01G 13/0256; A01G 13/0293; A01K 15/006; A01K 15/04; E01F 15/0469; E04H 17/009; E04H 17/063; E04H 17/08
USPC ..... 52/102; 256/1, 19, 32
See application file for complete search history.

(56) References Cited

U.S. PATENT DOCUMENTS 3,384,351 A * 5/1968 Turner, Jr. ..... E04H 17/063 256/32
3,713,624 A * 1/1973 Niemann ..... E04H 17/063 256/32
4,595,175 A 6/1986 Kauffman et al.
4,897,973 A * 2/1990 Foster, Jr. ..... E02D 31/06 404/7
4,907,783 A 3/1990 Fisk et al.
4,964,619 A 10/1990 Glidden, Jr.
5,328,156 A 7/1994 Hoke
5,615,866 A 4/1997 Kinnison
5,660,374 A * 8/1997 Dayberry ..... E04H 17/063 256/1
6,460,298 B1 * 10/2002 Elias ..... A01G 9/28 52/102
6,561,491 B2 * 5/2003 Thompson ..... E04H 17/063 256/1
7,004,458 B1 2/2006 Grubba et al.
8,272,624 B1 9/2012 Frazier
10,844,592 B2 * 11/2020 Jimenez ..... E04B 1/34342
2004/0000665 A1 1/2004 Himmelreich
(Continued)

FOREIGN PATENT DOCUMENTS

KR 19990017626 U * 5/1999 ..... E04H 17/08

*Primary Examiner* — Amber R Anderson
*Assistant Examiner* — Zachary A Hall
(74) *Attorney, Agent, or Firm* — Law Offices of Kevin M. Jones & Associates, LLC

(57) ABSTRACT

A trimmer line shield for preventing the line of a grass trimmer from striking and becoming entangled in the bottom portion of a chain link fence is formed of an elongated stiff plastic extrusion having a longitudinally extending vertical main body of generally T-shaped transverse cross section, a tapered bottom end, a pair of longitudinally extending stop flanges disposed a distance above the tapered bottom end extending laterally outward beyond each side of the main body, and a longitudinally extending flat top portion that extends a distance laterally outward beyond each side of the main body for engaging the bottom of the fence. The shield is driven into the ground to extend between vertical fence posts and the fence is installed between the posts with its bottom end engaging the flat top portion a distance above the ground surface which also inhibits growth of vegetation into the open spaces between the wire members.

5 Claims, 2 Drawing Sheets

(56) References Cited

U.S. PATENT DOCUMENTS

| | | | | |
|---|---|---|---|---|
| 2004/0163357 | A1* | 8/2004 | Gregory | E02D 27/50 52/747.12 |
| 2009/0188176 | A1* | 7/2009 | Watson | E02D 29/10 52/309.1 |
| 2009/0272954 | A1 | 11/2009 | Laird | |
| 2012/0204498 | A1* | 8/2012 | Richey | E02B 3/106 52/102 |
| 2014/0124723 | A1* | 5/2014 | Gill | E04F 11/1855 256/24 |

* cited by examiner

TRIMMER LINE SHIELD FOR CHAIN LINK FENCES

BACKGROUND OF THE INVENTION

1. Field of the Invention

This invention relates generally to protective guards secured to chain link or wire mesh fences and, more particularly, to a trimmer line shield for chain link fences for preventing a mower or line of an edger from striking the fence when mowing or edging adjacent to it. The trimmer line shield is formed of an elongated stiff plastic extrusion having a longitudinally extending vertical main body portion of generally T-shaped transverse cross section, a tapered bottom end, a pair of flat longitudinally extending stop flange members disposed a distance above the bottom end extending laterally outward beyond each side of the main bottom portion, and a longitudinally extending flat top portion that extends a distance laterally outward beyond each side of the main bottom portion for engaging the bottom of the fence.

2. Background Art

A common problem with chain link and wire mesh fences is that it is extremely difficult to mow or trim the grass, weeds and vegetation below and closely adjacent to the bottom of the fence, and the line of an edger often gets wound around the wires of the fence or broken when striking the fence. Another common problem is that grass, weeds and vegetation tend to grow below the bottom of the fence and between the open spaces between the wire members adjacent to the bottom of the fence.

There are several patents that disclose guards and barriers of various construction that are disposed at the bottom of a chain link or other types of fences that are intended to prevent the growth of vegetation and may also protect a trimmer line. The following are several examples.

Kauffman, et al, U.S. Pat. No. 4,595,175, discloses a fenceliner for inhibiting growth of grass, weeds and other vegetation beneath and closely adjacent a fence so as to make cutting or trimming of such vegetation unnecessary, and for inhibiting passage of small animals across the border defined by the fence. The fenceliner can be provided as a coiled strip of thin flexible material such as plastic or metal. The thin material is uncoiled and rolled out along the length of the fence and is cut to fit around fence posts. Preferably the material is colored to closely simulate the coloring of the surrounding vegetation. A centrally located longitudinal recess in the strip receives the bottom of the fence panels. Symmetric legs extend outwardly and downwardly from the recess to cover the ground closely adjacent to the fence. The legs have sufficient spring tension to bias the recess against the bottom of the fence panels when the fenceliner is in position on the ground beneath the fence.

Fisk, et al, U.S. Pat. No. 4,907,783, discloses a chain link fence lower edging strip which comprises an extruded flat strip of plastic having a pair of centrally molded parallel grooves that form pre-creased hinges allowing the extruded strip to be placed under a lower edge of a chain link fence and then folded upwardly into a U-shaped configuration. The outer top edges of the folded plastic strip are continuous molded fasteners that lockingly engage to a plurality of connectors passing through the openings in wire mesh of the chain link fence.

Glidden, Jr., U.S. Pat. No. 4,964,619 discloses an improved vegetation barrier installed along the bottom edge of a chain-link or similar type fence, in a manner that will beautify a lawn and reduce grooming time. The fence frame is a system of molded vegetation barriers that are installed easily with few or no tools. The fence frame consist of elongated molded vegetation barriers, preferably plastic, having two basic cross-sectional shapes. One has a basically rectangular shape, and the other has basically an L-shaped cross-section. Both types are longitudinally grooved to receive a series of upper spring clip brackets and corresponding base brackets that secure the vegetation barriers to the fence bottom and the underlying ground. Both types, in addition, are longitudinally grooved to receive uniquely designed splice covers, and post adapters that are snapped into position without the use of tools. The basic molding styles may be used singularly on one side of a fence or in combination using like or unlike styles on opposite sides. The molded barriers are of sufficient rigidity to protect the fence from the impact of mowing and trimming devices, and at the same time, serve as a guide for these devices. In a preferred form of the invention, the barriers are molded to give the appearance of a border of brick, stone, or a variety of decorative patterns.

Hoke, U.S. Pat. No. 5,328,156, discloses a self-attaching fence trim guard comprising A generally "U" shaped self-adhering plastic extrusion is firmly fitted to the bottom portion of a chain link or wooden fence without fasteners. Upstanding walls of the elongated plastic body are tapered towards the center having a neck for accepting the fence and a curved bottom to provide a channel on each side to rapidly drain off water. The tapered walls grip the fence in frictional engagement to hold the body member in place. The assembly includes short coupler members shaped to slide longitudinally in close frictional engagement over the outer surface of the body members where abutting ends are found. Couplers help secure the body members in place and cover the joint. The raised central ridge running along the length of the bottom positions the edge protector with respect to the bottom of the fence and holds the bottom of the fence elevated above drainage channels to protect the fence from moisture or termite damage.

Kinnison, U.S. Pat. No. 5,615,866, discloses a vegetation barrier device for use in association with the lowermost extremity of a fence is constructed of a first member having an L-shaped extruded configuration and a second member in the form of an elongated flat strip. The two members are assembled upon the fence by bolts which penetrate the fence and both members to form a U-shaped structure defining an interior region capable of releasably holding a water-leachable insecticidal agent.

Grubba, et al, U.S. Pat. No. 7,004,458, discloses two embodiments of fence bottom shields that prevent grass and weeds from growing up through the links or low openings in a fence. The first embodiment comprises a first strip and a second strip whose bottoms are integrally connected. Two end tabs are attached to one end of the first strip and the second strip, and a tab receiving slot is defined by the opposing end of the first strip and the second strip. A plurality of screw holes are defined by holes in the end tabs and the sidewalls of the first strip and second strip. Two fence bottom shields can be joined by inserting the end tab into the tab receiving slot and inserting two screws into the screw holes. The second embodiment comprises a first strip connected to a second strip by a bottom tab inserted into a bottom slot that is secured by a bolt and nut. Two end tabs are attached to one end of the first strip and the second strip, and a tab receiving slot is defined by the opposing end of the first strip and the second strip. Two fence bottom shields can be joined by snapping together the end tabs and the tab receiving slot. In both embodiments, a fence slot is defined by the sidewalls of the first strip and second strip.

Frazier, U.S. Pat. No. 8,272,624, discloses a fence engageable weed barrier system which includes a fence that is mounted in and extends upwardly from a ground surface. The fence includes a fence section comprising at least one post and a dividing wall attached to and extending laterally away from the at least one post. Each of a plurality of primary barriers is positioned beneath the fence section and receives a bottom edge of the dividing wall to prevent weed growth beneath the fence section. Each of the primary barriers includes a base wall that has a top side a front edge and a back edge. A back wall is attached to and extends upwardly from the back edge. A front wall is attached to and extends upwardly from the front edge. A dividing wall receiving space is defined between the front and back walls and receives the bottom edge of the dividing wall.

My previous U.S. Pat. No. 9,840,853, which is hereby incorporated herein by reference, discloses an edging and vegetation guard assembly which includes at least one pair of elongate first and second base members each having a vertical front wall with a generally rectangular upper portion that are installed on opposed sides of the bottom of a chain link or wire mesh fence in parallel opposed relation and form a generally rectangular enclosure along the bottom of the fence which is filled with foam insulation material for preventing a mower or line of an edger from striking the fence when mowing or edging adjacent to it, and inhibit the undesirable growth of vegetation below the bottom of the fence and between the open spaces adjacent to the bottom of the fence.

Himmelreich, US Published Application No. 2004/0000665, discloses a fence liner for placement on the ground to prevent the growth of plant material underneath a fence, which has a fixed width and a length that can either be cut to cover a desired area or fixed lengths of the fence liner can be used together to cover a given area. The fence liner includes a top portion, a bottom portion and two reinforced edge sections running the length of the fence liner and contacting the ground. In one embodiment, two or more support sections are provided; the two or more support sections formed along the length of the fence liner. A base of each of the support section contacts the ground, the fence liner includes one or more tab connection areas, which are used to connect two lengths of the fence liner.

Laird, US Published Application No. 2009/0272954, discloses a fence edge guard including an elongated channel-shaped body member having a bottom, and upstanding opposed sidewalls extending upwardly from opposed side edges of the bottom and terminating at an open top, and an interior elongated channel defined by the bottom and said sidewalls. A plurality of openings are longitudinally spaced along the bottom. A plurality of spring means are spaced longitudinally along the body for securing the body along the bottom edge of a chain link fence such that the bottom of the fence edge guard is urged upwardly towards the bottom edge of the chain link fence. The fence edge guard is useful in preventing vegetation from growing through the opens of the chain link fence, preventing damage and excess wear on line trimmer cutting lines, and for providing a gap between the bottom of the fence and the ground to permit trimming of vegetation below the fence.

SUMMARY OF THE INVENTION

The present invention is distinguished over the prior art in general, and these patents in particular by a trimmer line shield for chain link fences for preventing a mower or line of an edger from striking the fence when mowing or edging adjacent to it. The trimmer line shield is formed of an elongated stiff plastic extrusion having a longitudinally extending vertical main body portion of generally T-shaped transverse cross section and a tapered bottom end, and a longitudinally extending flat top portion that extends a distance laterally outward beyond each side of the main bottom portion for engaging the bottom of the fence, and a pair of flat longitudinally extending stop flange members disposed a distance above the tapered bottom end extending laterally outward beyond each side of the main bottom portion.

The trimmer line shield is driven into the ground to extend between vertical fence posts and the chain link fence is installed between the posts such that its bottom end engages the flat top portion of the shield to prevent the line of a grass trimmer from striking and becoming entangled in the open spaces adjacent to the bottom portion of the chain link fence. The trimmer shield also maintains the bottom of the fence a distance above the ground surface and inhibits the undesirable growth of vegetation into the open spaces between the wire members along the bottom of the fence.

The trimmer line shield may include a plurality of holes extending vertically through said flat top portion adjacent to outer sides thereof in longitudinally spaced relation, and a plurality of fasteners configured to extend through the holes of the shield and through the open spaces adjacent to the bottom portion of the chain link fence to secure the bottom portion of the chain link fence to the trimmer line shield at selected locations. The trimmer shield also maintains the bottom of the fence a distance above the ground surface and inhibits the undesirable growth of vegetation into the open spaces along the bottom of the fence.

DETAILED DESCRIPTION OF THE INVENTION

Figure 1:
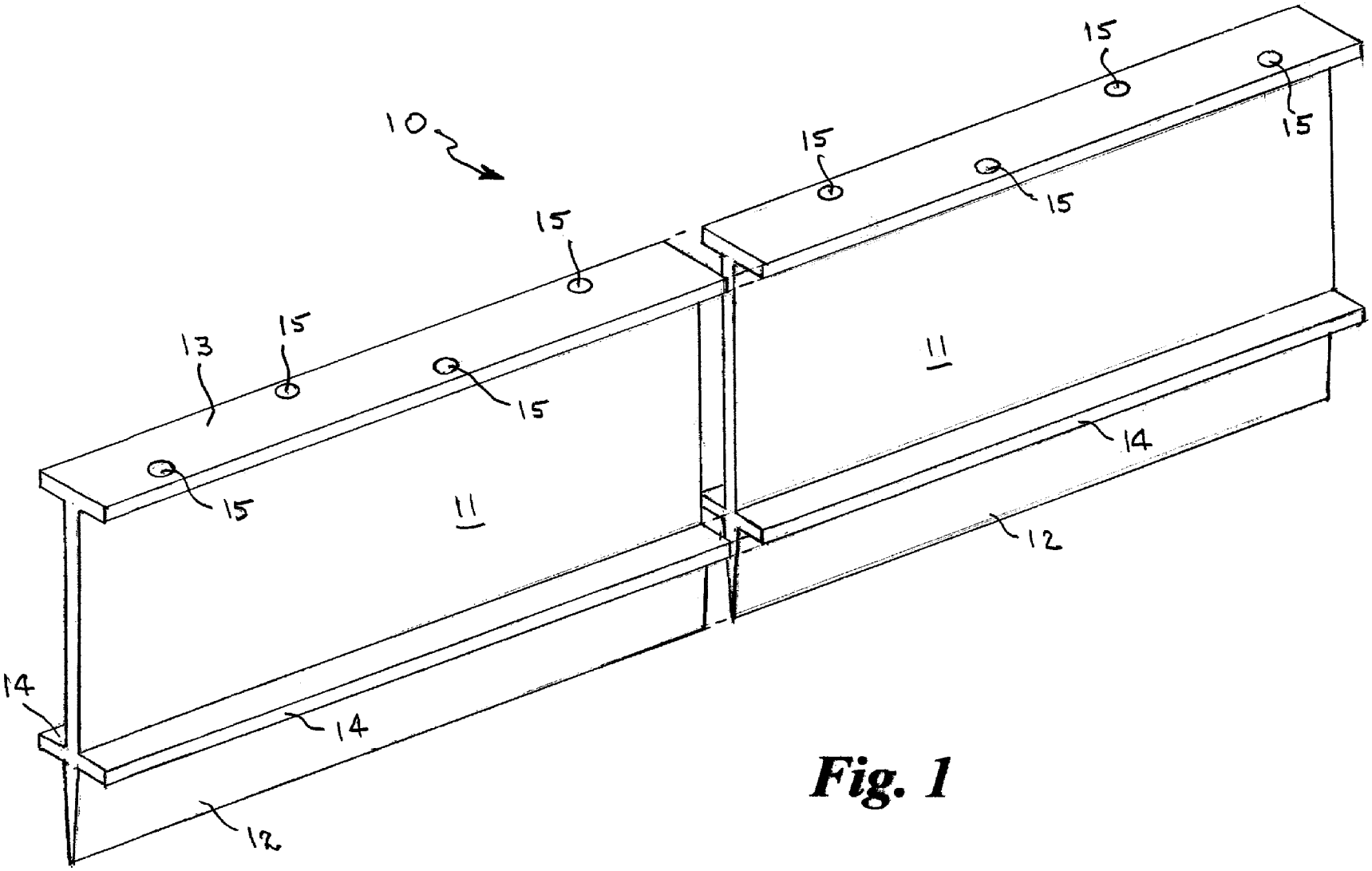
FIG. 1 is a perspective view of the trimmer line shield as seen from the top, one end, and one side, the opposed end and side being a mirror image thereof.
Figure 2:
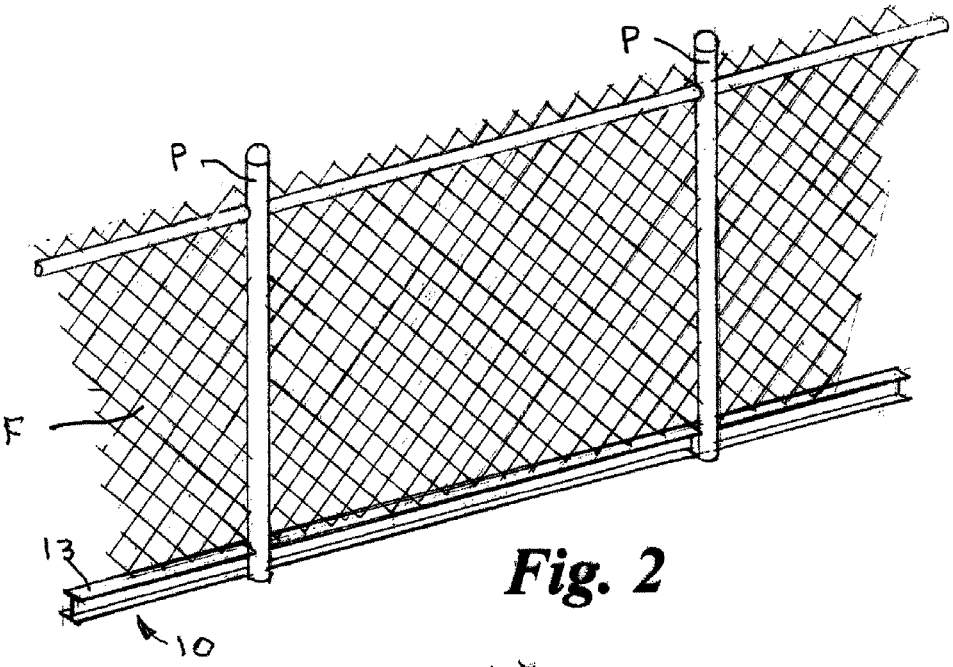
FIG. 2 a perspective view of the trimmer line shield shown installed beneath the bottom of a chain link fence.

Referring now to the drawings by numerals of reference there is shown a trimmer line shield 10 for chain link fences in accordance with the present invention. The trimmer line shield 10 is formed of an elongated stiff plastic extrusion which has a longitudinally extending vertical main body portion 11 having a generally T-shaped transverse cross section with a tapered bottom end 12, a longitudinally extending flat top portion 13 that extends a distance laterally outward beyond each side of the main bottom portion 11 for engaging the bottom of the fence.

A pair of flat integrally formed longitudinally extending stop flange members 14 disposed a distance above the tapered bottom end 12 extend laterally outward beyond each side of the main bottom portion 11.

The trimmer line shield 10 is installed between the lower ends of pre-installed vertical fence posts P to extend therebetween by driving the tapered bottom end 12 into the ground until the stop flange members 14 engage and rest on the ground surface.

Thereafter, the chain link fence F is installed between the vertical fence posts P in the conventional manner such that its bottom end engages, and rests on, the flat top portion 13 of the trimmer line shield 10.

After installation, the trimmer line shield 10 prevents the line of a grass trimmer from striking and becoming entangled in the open spaces and wire members adjacent to the bottom portion of the chain link fence F when trimming grass adjacent to it. The trimmer shield 10 also maintains the bottom of the fence F a distance above the ground surface and inhibits the undesirable growth of vegetation into the open spaces between the wire members along the bottom of the fence.

The trimmer line shield 10 may also be provided with a plurality of holes 15 that extend vertically through the flat top portion 13 adjacent to outer sides thereof in longitudinally spaced relation for receiving fasteners to secure the bottom of the fence to the trimmer line shield at selected locations.

Figure 3:
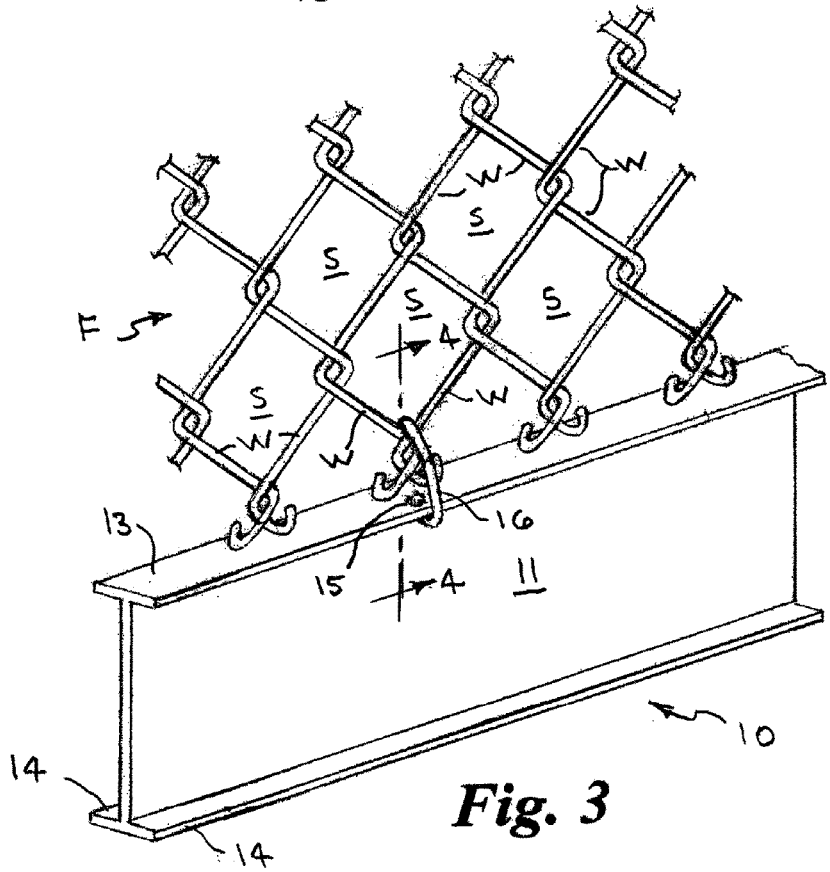
FIG. 3 is an enlarged perspective view of a portion of the trimmer line shield connected to the bottom of the chain link fence with a fastener.
Figure 4:
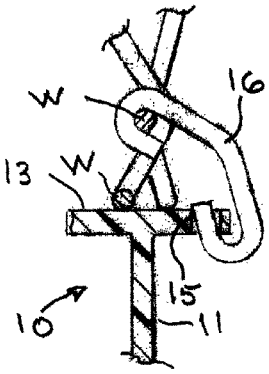
FIG. 4 is a transverse cross section view through the upper portion of the trimmer line shield and bottom portion of the chain link fence taken along line 4-4 of FIG. 3, showing the fastener installed between in a hole in the top portion of the shield and the wire members surrounding an open spaces adjacent to the bottom of the chain link fence.

FIGS. 3 and 4 show a fastener 16 installed in a hole 15 in the top portion 13 of the shield and the wire members W surrounding an open space S adjacent to the bottom of the chain link fence F. In the example of FIGS. 3 and 4, but not limited thereto, the fastener 16 is in the form of a "hog ring" (a C-shaped piece of metal wire). The following are several other examples of suitable fasteners that may be used: D-rings, hog rings, fence ties, pull ties, and cable ties.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A trimmer line shield for chain link fences, comprising:

an elongated extrusion having a longitudinally extending vertical main body portion having a generally T-shaped transverse cross section and a tapered bottom end;

a longitudinally extending flat top portion that extends a distance laterally outward beyond each side of the top of the main body portion for engaging the bottom of chain link fencing; and a pair of flat longitudinally extending stop flange members parallel to the longitudinally extending flat top portion and disposed a distance above the tapered bottom end, disposed a distance below the longitudinally extending flat top portion, and extending laterally outward from each said side of the main body portion; wherein the shield is driven into ground supporting the fence to extend between two adjacent spaced vertical fence posts and chain link fencing installed between the posts such that the fencing's bottom end engages the flat top portion to prevent line of a trimmer from striking and becoming entangled with the chain link fence.

2. The trimmer line shield according to claim 1 further comprising:

a plurality of holes extending vertically through said flat top portion adjacent to said outer sides thereof in longitudinally spaced relation; and a plurality of fasteners configured to extend through said holes and attach to the bottom of the chain link fence at selected locations to secure the chain link fence to the top of the trimmer line shield.

3. The trimmer line shield according to claim 2, wherein said fasteners are selected from a group consisting of D-rings, hog rings, fence ties, pull ties, and cable ties.

4. A method for preventing a trimmer line of an edger from striking a chain link fence and inhibiting growth of vegetation below and adjacent to the bottom of the fence, comprising:

providing a trimmer line shield having a longitudinally extending vertical main body portion of generally T-shaped transverse cross section, a tapered bottom end, a longitudinally extending flat top portion that extends a distance laterally outward beyond each side of the top of the main body portion for engaging the bottom of the fencing, and a pair of flat longitudinally extending stop flanges parallel to the longitudinally extending flat top portion and disposed a distance above the tapered bottom end, disposed a distance below the longitudinally extending flat top portion, and extending laterally outward from each said side of the main body portion;

driving the trimmer line shield into the ground to extend between two adjacent spaced vertical fence posts with its said stop flanges engaged on the surface of the ground;

installing chain link fencing between the adjacent fence posts such that the chain link fencing's bottom end engages the flat top portion to prevent the line of a trimmer from striking and becoming entangled within the chain link fence, and the bottom of the fence is disposed a distance above the ground surface to inhibit growth of the vegetation adjacent to the bottom of the fence.

5. The method according to claim 4, wherein the trimmer line shield has a plurality of holes extending vertically through said flat top portion in longitudinally spaced relation, and including the further step of:

securing fasteners between the holes in the flat top portion of the trimmer line shield and the bottom of the chain link fence at selected locations to maintain the bottom of the fence the distance above the ground surface.

* * * * *